US010094568B2

(12) United States Patent
Bethke

(10) Patent No.: US 10,094,568 B2
(45) Date of Patent: Oct. 9, 2018

(54) COMBUSTOR DYNAMICS MITIGATION

(71) Applicant: General Electric Company, Schenectady, NY (US)

(72) Inventor: Sven Georg Bethke, Greenville, SC (US)

(73) Assignee: General Electric Company, Schenectady, NY (US)

( * ) Notice: Subject to any disclaimer, the term of this patent is extended or adjusted under 35 U.S.C. 154(b) by 474 days.

(21) Appl. No.: 14/470,984

(22) Filed: Aug. 28, 2014

(65) Prior Publication Data

US 2016/0061453 A1 Mar. 3, 2016

(51) Int. Cl.
*F23R 3/28* (2006.01)

(52) U.S. Cl.
CPC .... *F23R 3/286* (2013.01); *F23D 2900/00017* (2013.01); *F23R 2900/00014* (2013.01)

(58) Field of Classification Search
CPC .. F23R 2900/00014; F23R 3/32; F23R 3/002; F23R 3/286; F23R 2900/00017; F02C 7/24; F05D 2260/963; F05D 2260/964; F23D 14/02
See application file for complete search history.

(56) References Cited

U.S. PATENT DOCUMENTS 7,578,130 B1 * 8/2009 Kraemer ..... F23R 3/286 60/737
2009/0061369 A1 * 3/2009 Wang ..... F23M 20/005 431/114
2011/0016871 A1 * 1/2011 Kraemer ..... F23N 5/082 60/772
2011/0083439 A1 * 4/2011 Zuo ..... F23D 14/64 60/737
2012/0006033 A1 * 1/2012 Kim ..... F23C 5/08 60/772
2012/0180487 A1 * 7/2012 Uhm ..... F23D 14/62 60/737
2012/0180495 A1 * 7/2012 Uhm ..... F23R 3/04 60/772
2013/0104556 A1 * 5/2013 Uhm ..... F23L 7/005 60/772
2013/0241089 A1 9/2013 Westmoreland, III et al.
(Continued)

*Primary Examiner* — Gerald L Sung
*Assistant Examiner* — William Breazeal
(74) *Attorney, Agent, or Firm* — Charlotte C. Wilson; Ernest G. Cusick

(57) ABSTRACT

A combustor includes a plurality of bundled tube fuel nozzles which are annularly arranged around a common axial centerline. The plurality of bundled tube fuel nozzles comprise a first bundled tube fuel nozzle and a second bundled tube fuel nozzle. The first bundled tube fuel nozzle includes a first fuel plenum and a plurality of premix tubes which extend axially therethrough. The second bundled tube fuel nozzle includes a second fuel plenum and a plurality of premix tubes which extend axially therethrough. The first fuel plenum is axially offset at a predefined axial distance from the second fuel plenum so as to mitigate combustion tones within the combustor. In one embodiment, premix tube fuel ports disposed within the first and/or second fuel plenums may be axially offset with respect to each other within the corresponding fuel plenums at a predefined axial distance to mitigate combustion tones within the combustor.

9 Claims, 3 Drawing Sheets

(56) References Cited

U.S. PATENT DOCUMENTS

| | | | | |
|---|---|---|---|---|
| 2013/0247581 | A1* | 9/2013 | Melton | F23R 3/286 60/779 |
| 2014/0053528 | A1* | 2/2014 | Crothers | F23R 3/18 60/39.37 |
| 2014/0109587 | A1* | 4/2014 | Crothers | F02C 7/22 60/776 |
| 2014/0245738 | A1* | 9/2014 | Crothers | F02C 7/228 60/725 |
| 2015/0219336 | A1* | 8/2015 | Crothers | F23R 3/34 60/726 |

* cited by examiner

COMBUSTOR DYNAMICS MITIGATION

FIELD OF THE INVENTION

The present invention generally involves a combustor for a gas turbine. More specifically, the invention relates to a combustor having sectored bundled tube fuel nozzles which is configured to mitigate high and low frequency combustion dynamics within the combustor.

BACKGROUND OF THE INVENTION

Gas turbines are widely used in industrial, marine, aircraft and power generation operations. A gas turbine includes a compressor section, a combustion section disposed downstream from the compressor section and a turbine section positioned downstream from the combustion section. The combustion section generally includes multiple combustor cans annularly arranged around an outer casing such as a compressor discharge casing. In particular configurations, each combustor can includes multiple bundled tube or micro-mixer type fuel nozzles annularly arranged around a center fuel nozzle.

Combustion instability/dynamics is a phenomenon which occurs in gas turbines that utilize lean pre-mixed combustion such as those having bundled tube or micro-mixer type fuel nozzles. Depending on the nature or mechanism of excitation of combustion chamber modes, combustion instability can be low/high frequency. A low or lower frequency (i.e. 200-400 Hz) combustion dynamics field is caused by excitation of axial modes, whereas a high or higher frequency (i.e. greater than about 1.0 kHz) dynamic field is generally caused by the excitation of radial and azimuthal modes of the combustion chambers and is commonly referred to as screech.

The overall dynamic field created includes a combustion field component and an acoustic component that pass along the combustor during combustion. Under certain operating conditions, the combustion component and the acoustic component couple to create a high and/or low frequency dynamic field which may have a negative impact on various gas turbine components such as combustion liners, transition pieces. In addition, the high frequency dynamic field may excite modes of downstream gas turbine components such as turbine blades, thus potentially contributing to high cycle fatigue.

In-phase combustion dynamics are particularly of concern when instabilities between the adjacent cans are coherent (i.e., there is a strong relationship in the frequency and the amplitude of the instability from one can to the next can). Such coherent in-phase combustion dynamics can also excite the turbine blades and lead to durability issues, thereby limiting the operability of the gas turbine.

Current systems and/or methodologies for mitigating combustion dynamics include damping systems which are designed to mitigate one particular frequency and/or a limited frequency range. For example, either the high frequency tones or the low frequency tones. Accordingly, a system for mitigating both low and high frequency in-phase combustion dynamics within combustors, particularly those which include bundled tube fuel nozzles, would be useful.

BRIEF DESCRIPTION OF THE INVENTION

Aspects and advantages of the invention are set forth below in the following description, or may be obvious from the description, or may be learned through practice of the invention.

One embodiment of the present invention is a combustor. The combustor includes a plurality of bundled tube fuel nozzles which are annularly arranged around a common axial centerline. The plurality of bundled tube fuel nozzles comprise a first bundled tube fuel nozzle and a second bundled tube fuel nozzle. The first bundled tube fuel nozzle includes a first fuel plenum and a plurality of premix tubes which extend axially therethrough. The second bundled tube fuel nozzle includes a second fuel plenum and a plurality of premix tubes which extend axially therethrough. The first fuel plenum is axially offset at a predefined axial distance from the second fuel plenum with respect to the common axial centerline so as to mitigate in-phase and/or coherent combustion dynamics within the combustor.

Another embodiment of the present disclosure is a combustor. The combustor includes an end cover which is coupled to an outer casing. the combustor further includes a plurality of bundled tube fuel nozzles which are annularly arranged around a common axial centerline where each bundled tube fuel nozzle is fluidly connected to the end cover via a fluid conduit which extends downstream from the end cover. The plurality of bundled tube fuel nozzles comprise a first bundled tube fuel nozzle and a second bundled tube fuel nozzle. The first bundled tube fuel nozzle includes a first fuel plenum and a plurality of premix tubes which extend axially therethrough. The second bundled tube fuel nozzle includes a second fuel plenum and a plurality of premix tubes which extend axially therethrough. The plurality of premix tubes of the first bundled tube fuel nozzle includes a first premix tube having a first fuel port which is disposed within the first fuel plenum and a second premix tube having a second fuel port which is disposed within the first fuel plenum. The plurality of premix tubes of the second bundled tube fuel nozzle includes a first premix tube having a first fuel port which is disposed within the second fuel plenum and a second premix tube having a second fuel port which is disposed within the second fuel plenum. The first fuel plenum is axially offset at a predefined axial distance from the second fuel plenum with respect to the common axial centerline so as to mitigate in-phase and/or coherent combustion dynamics within the combustor.

The present invention also includes a gas turbine. The gas turbine includes a compressor section, a combustion section having a plurality of combustors annularly arranged around an outer casing downstream from the compressor section and a turbine section disposed downstream from the combustors. Each combustor includes an end cover and a plurality of bundled tube fuel nozzles which extend downstream from the end cover. The bundled tube fuel nozzles are annularly arranged around a common axial centerline. The plurality of bundled tube fuel nozzles comprises a first bundled tube fuel nozzle and a second bundled tube fuel nozzle. The first bundled tube fuel nozzle includes a first fuel plenum and a plurality of premix tubes which extend axially therethrough. The second bundled tube fuel nozzle includes a second fuel plenum and a plurality of premix tubes which extend axially therethrough. The first fuel plenum is axially offset at a predefined axial distance from the second fuel plenum with respect to the common axial centerline so as to mitigate in-phase and/or coherent combustion dynamics within the combustor.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
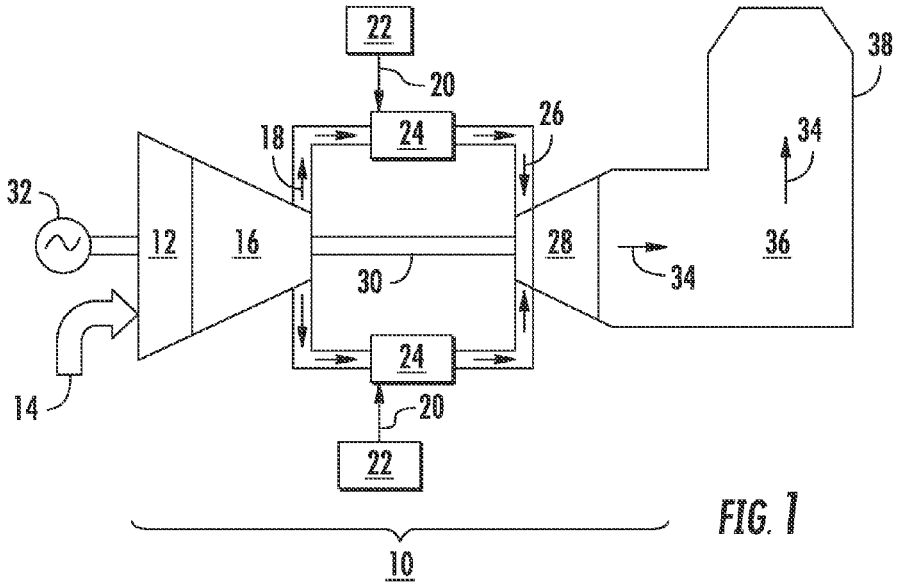
FIG. 1 is a functional block diagram of an exemplary gas turbine that may incorporate various embodiments of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents. Although exemplary embodiments of the present invention will be described generally in the context of a bundled tube fuel nozzle for a land based power generating gas turbine combustor for purposes of illustration, one of ordinary skill in the art will readily appreciate that embodiments of the present invention may be applied to any combustor for any type of gas turbine such as a marine or aircraft gas turbine and are not limited to combustors or combustion systems for land based power generating gas turbines unless specifically recited in the claims.

Referring now to the drawings, wherein identical numerals indicate the same elements throughout the figures, FIG. 1 provides a functional block diagram of an exemplary gas turbine 10 that may incorporate various embodiments of the present invention. As shown, the gas turbine 10 generally includes an inlet section 12 that may include a series of filters, cooling coils, moisture separators, and/or other devices to purify and otherwise condition air 14 or other working fluid entering the gas turbine 10. The air 14 flows to a compressor section where a compressor 16 progressively imparts kinetic energy to the air 14 to produce compressed air 18.

The compressed air 18 is mixed with a fuel 20 from a fuel supply system 22 to form a combustible mixture within one or more combustors 24. The combustible mixture is burned to produce combustion gases 26 having a high temperature, pressure and velocity. The combustion gases 26 flow through a turbine 28 of a turbine section to produce work. For example, the turbine 28 may be connected to a shaft 30 so that rotation of the turbine 28 drives the compressor 16 to produce the compressed air 18. Alternately or in addition, the shaft 30 may connect the turbine 28 to a generator 32 for producing electricity. Exhaust gases 34 from the turbine 28 flow through an exhaust section 36 that connects the turbine 28 to an exhaust stack 38 downstream from the turbine 28. The exhaust section 36 may include, for example, a heat recovery steam generator (not shown) for cleaning and extracting additional heat from the exhaust gases 34 prior to release to the environment.

Figure 2:
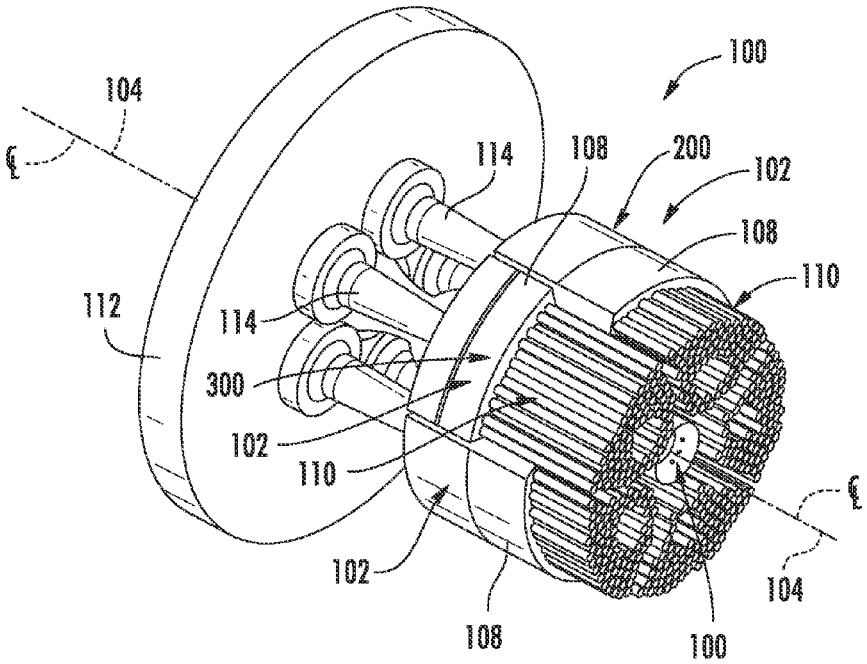
FIG. 2 is a side perspective view of an exemplary combustor as may incorporate various embodiments of the present invention.

The combustor 24 may be any type of combustor known in the art, and the present invention is not limited to any particular combustor design unless specifically recited in the claims. For example, the combustor 24 may be a can-annular or an annular combustor. FIG. 2 provides a perspective side view of a portion of an exemplary combustor 100 as may be incorporated in the gas turbine 10 shown in FIG. 1, according to one or more embodiments of the present invention.

In an exemplary embodiment, as shown in FIG. 2, the combustor 100 includes a plurality of bundled tube fuel nozzles 102 annularly arranged around a common axial centerline 104. In particular embodiments, the bundled tube fuel nozzles 102 may be annularly arranged around a center fuel nozzle 106 which is substantially coaxially aligned with centerline 104. Each bundled tube fuel nozzle 102 includes a fuel plenum 108 and a plurality of premix tubes 110 which extend substantially axially through the fuel plenum 108 with respect to centerline 104.

In particular embodiments, each bundled tube fuel nozzle 102 is connected to an end cover 112 of the combustor 100 via a conduit or tube 114. The conduit 114 extends axially downstream from the end cover 112 and provides for fluid communication between the end cover 112 and/or a fuel supply (not shown) and a corresponding fuel plenum 108. In addition, the conduits 114 may provide structural support for the generally cantilevered bundled fuel nozzles 102.

In operation, a portion of the compressed air 18 flows towards the end cover 112 where it reverses direction and flows into inlets of each premixing tube 110 of the bundled tube fuel nozzles 102. Fuel is provided to at least one of the fuel plenums 108 via a corresponding fluid conduit 114. The fuel is injected from the fuel plenum 108 into each of the premix tubes of the corresponding bundled tube fuel nozzle 102 via one or more fuel ports (not shown in FIG. 2) defined within the premix tubes 110. The fuel premixes with the compressed air 18 within each premix tube 110 as it travels an axial distance with respect to centerline 104 towards an outlet of each premix tube 110. The fuel and air mixture exits the outlets of each premix tube 110 and enters a flame or combustion zone where it is burned to produce the combustion gases 26 having a high temperature, pressure and velocity. The time between when the fuel is injected into the individual premix tubes 110 of the bundled tube fuel nozzles 102 and the time when it reaches the flame zone is conventionally known in the art as "convective time".

Combustion instabilities may result from an interaction or coupling of the combustion process or flame dynamics with one or more acoustic resonant frequencies of the combustor. For example, one mechanism of combustion instability may occur when acoustic pressure pulsations cause a mass flow fluctuation at a fuel injection point upstream from or just adjacent to the combustion flame (i.e. adjacent to the premix tube outlets) which then results in a fuel-air ratio fluctuation in the flame. When the resulting fuel/air ratio fluctuation and the acoustic pressure pulsations have a certain phase behavior (e.g., in-phase or approximately in-phase), a self-excited frequency feedback loop may result which may cause flame blow out, inefficient combustion and/or hardware life reduction. In addition or in the alternative, another mechanism for generating combustion instabilities may result from changes of load or demand on the gas turbine changes wherein fuel flow rate to the various fuel nozzles may be regulated and/or turned on or off to increase or decrease the output of the gas turbine.

Higher frequency in-phase tones may also be produced by one or more of the mechanisms previously mentioned and are particularly a concern because of their ability to potentially excite turbine blades disposed downstream from the combustor cans. For example, the higher frequency in-phase tones may coincide with the natural frequency of the turbine blades, thereby potentially impacting the mechanical life of the blades. In-phase tones are particularly of concern when instabilities between the adjacent cans are coherent (i.e., there is a strong relationship in the frequency and the amplitude of the instability from one can to the next can). Such coherent in-phase tones can excite the turbine blades and lead to durability issues, thereby limiting the operability of the gas turbine.

Figure 3:
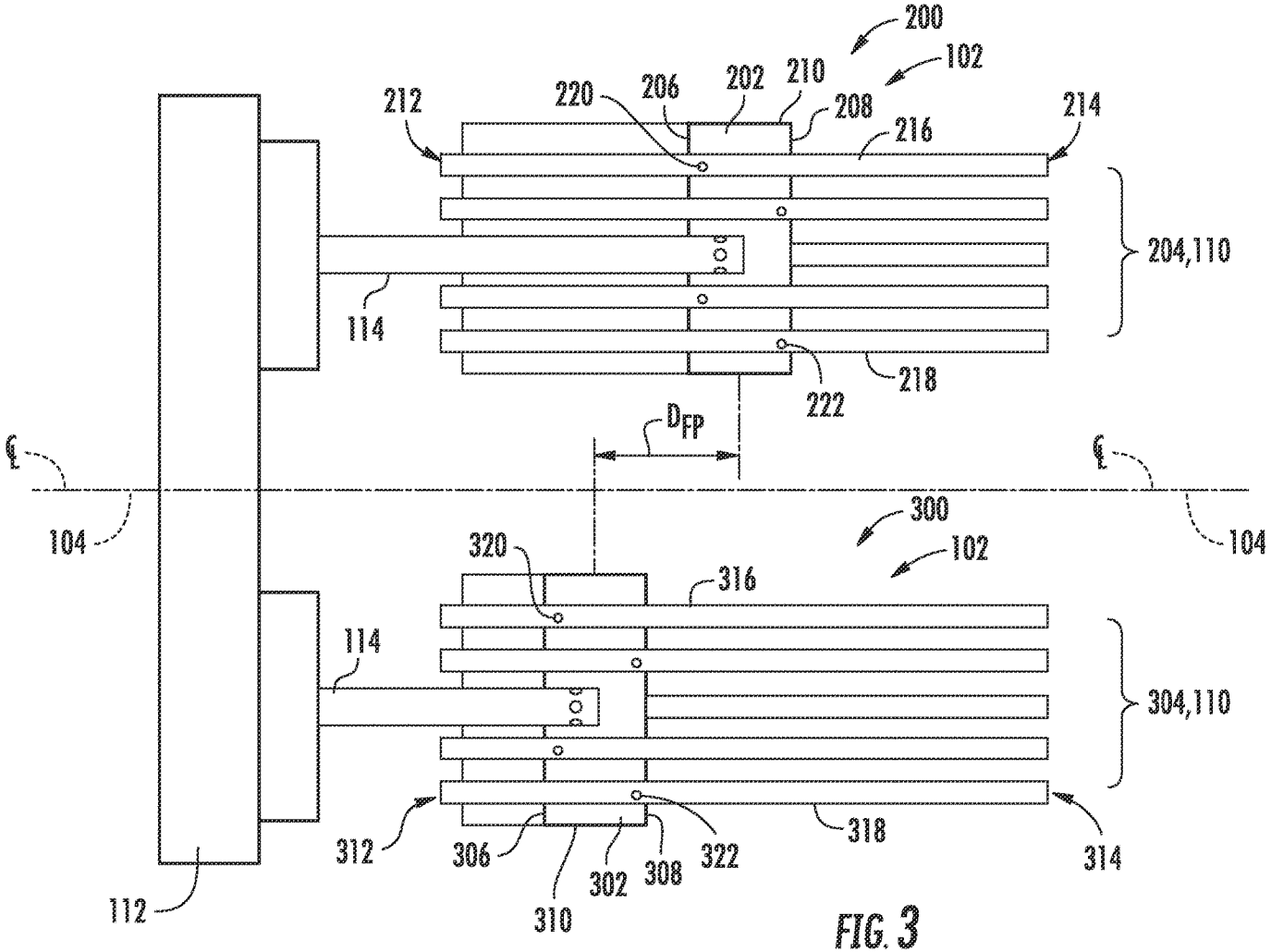
FIG. 3 is a cross sectional side view of a portion of the combustor as shown in FIG. 2, according to at least one embodiment of the present invention.
Figure 4:
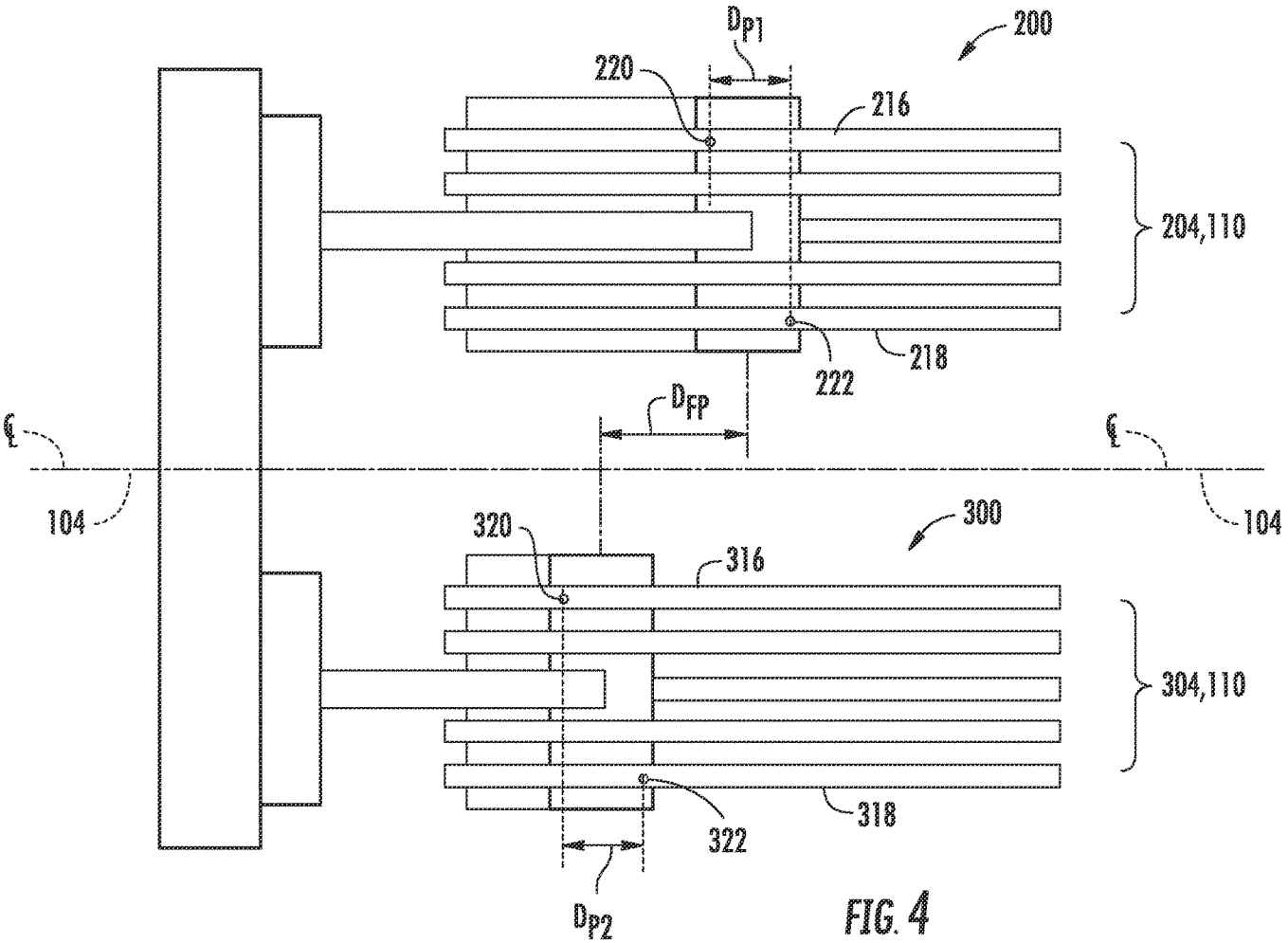
FIG. 4 is a cross sectional side view of a portion of the combustor as shown in FIG. 2, according to at least one embodiment of the present invention.

FIGS. 3 and 4 provide simplified cross sectional side views of two exemplary bundled tube fuel nozzles 102 configured to mitigate, prevent and/or interfere with various frequencies including but not limited to in-phase/coherent frequencies within both a lower frequency range (i.e. less than about 800 Hz) and a higher frequency range (i.e. greater than about 800 Hz) within the combustors, according to one or more embodiments of the present invention. In one embodiment, as shown in FIGS. 2, 3 and 4, the plurality of bundled tube fuel nozzles 102 includes a first bundled tube fuel nozzle 200 and a second bundled tube fuel nozzle 300.

As shown in FIG. 3, the first bundled tube fuel nozzle 200 includes a first fuel plenum 202 and a plurality of premix tubes 204 which extend substantially axially through the first fuel plenum 202. In particular embodiments, the first fuel plenum 202 is at least partially defined by a forward plate 206 and an aft plate 208 which is axially separated or spaced from the forward plate 206 with respect to centerline 104. The first fuel plenum 202 may be further defined by an outer shroud 210 which extends axially between the forward and aft plates 206, 208. Each premix tube 204 includes an inlet 212 disposed at an upstream end of the corresponding premix tube 204 and an outlet 214 disposed at a downstream end of the corresponding premix tube 204.

Each of the premix tubes 204 of the first bundled tube fuel nozzle 200 may include at least one fuel port disposed within the first fuel plenum 202. In one embodiment, the plurality of premix tubes 204 includes a first premix tube 216 and a second premix tube 218. The first premix tube 216 includes a first fuel port 220 disposed within and in fluid communication with the first fuel plenum 202. The second premix tube 218 includes a second fuel port 222 disposed within and in fluid communication with the first fuel plenum 202. The fuel ports 220 and 222 provide for fluid communication between the first fuel plenum 202 and a premix passage defined by each corresponding premix tube 216, 218.

As shown in FIG. 3, the second bundled tube fuel nozzle 300 includes a first fuel plenum 302 and a plurality of premix tubes 304 which extend substantially axially through the second fuel plenum 302. In particular embodiments, the second fuel plenum 302 is at least partially defined by a forward plate 306 and an aft plate 308 which is axially separated or spaced from the forward plate 306 with respect to centerline 104. The second fuel plenum 302 may be further defined by an outer shroud 310 which extends axially between the forward and aft plates 306, 308. Each premix tube 304 includes an inlet 312 disposed at an upstream end of the corresponding premix tube 304 and an outlet 314 disposed at a downstream end of the corresponding premix tube 304.

Each of the premix tubes 304 of the second bundled tube fuel nozzle 300 may include at least one fuel port disposed within the second fuel plenum 302. In one embodiment, the plurality of premix tubes 304 includes a first premix tube 316 and a second premix tube 318. The first premix tube 316 includes a first fuel port 320 disposed within and in fluid communication with the second fuel plenum 302. The second premix tube 318 includes a second fuel port 322 disposed within and in fluid communication with the second fuel plenum 302. The fuel ports 320 and 322 provide for fluid communication between the second fuel plenum 302 and separate premix passages defined by each corresponding premix tube 316, 318. In particular embodiments, the premix tubes 204 and 304 are substantially equal in axial length.

It has been shown that the mechanisms which result in combustion instabilities and the resulting magnitude of the combustion dynamics depends, at least in part, on the time between the injection of the fuel into the individual tubes of the bundled tube fuel nozzles and the time when it reaches the flame zone, conventionally known in the art as "convective time". Generally, there is an inverse relationship between convective time and frequency. For example, as the convective time increases, the frequency of the combustion instabilities decreases, and when the convective time decreases, the frequency of the combustion instabilities increases.

In one embodiment, as shown in FIG. 3, the first fuel plenum 202 is axially offset from the second fuel plenum 302 a predefined axial distance $D_{FP}$ with respect to the centerline 104. In this manner, the convection time for the first bundled tube fuel nozzle 200 is less than the convection time for the second bundled tube fuel nozzle 300. As a result of the axial offset, a destructive interference between the low frequency combustion dynamics caused by combustion instabilities occurs, thereby mitigating potential adverse effects of in-phase/coherent lower frequencies within the combustor.

In one embodiment, the axial distance $D_{FP}$ between the first and second fuel plenums 202, 302 may be measured between the forward plates 206, 306 of the first and second bundled tube fuel nozzles 200, 300. In another embodiment, the axial distance $D_{FP}$ between the first and second fuel plenums 202, 302 may be measured between the aft plates 208, 308 of the first and second bundled tube fuel nozzles 200, 300. In another embodiment, the axial distance $D_{FP}$ between the first and second fuel plenums 202, 302 may be measured between radial centerlines which extend through the respective fuel plenums 202, 302 at points taken axially between the forward and aft plates 206, 208 and 306, 308.

In an exemplary embodiment, the predefined axial distance $D_{FP}$ between the fuel plenums 202, 302 that is needed for optimum destructive interference depends, at least in part, on flow velocity of the mixture of the compressed air 18 and fuel flowing through the premix tubes 204, 304 and an identified target frequency which is to be mitigated. For example, in particular embodiments the following formula may be used to determine the proper axial distance $D_{FP}$:

$$D_{FP} = \frac{v_{(tube)}}{2 \cdot Freq}$$

where $v_{(tube)}$ corresponds to the flow velocity of the compressed air 18 and/or the compressed air 18 and fuel mixture through the premixer tubes 204, 304 and Freq corresponds to a frequency to be mitigated. As evident from the equation provided, a lower frequency results in a greater axial distance $D_{FP}$. In contrast, a higher frequency results in a shorter axial distance $D_{FP}$.

In addition or in the alternative, higher frequency combustion dynamics may be mitigated by axially offsetting the fuel ports 220, 222 and/or 320, 322 with respect to the centerline 104 of the corresponding premix tubes 216, 218 and 316, 318 within the corresponding fuel plenums 202, 302 of the corresponding first and/or second bundled tube fuel nozzles 200, 300, thus modifying the convection time between fuel injection into the flow of compressed air and introduction into the combustion zone for individual bundled tube fuel nozzles. For example, in one embodiment, as shown in FIG. 4, the first and second fuel plenums 202, 302 are axially offset at a predefined axial distance $D_{FP}$ and the first and second fuel ports 220, 222 of the first bundled tube fuel nozzle 200 are axially offset at an axial distance $D_{P1}$. In one embodiment, the first and second fuel plenums 202, 302 are axially offset at a predefined axial distance $D_{FP}$ and the first and second fuel ports 320, 322 of the second bundled tube fuel nozzle 300 are axially offset at an axial distance $D_{P2}$. In another configuration, the first and second fuel plenums 202, 302 are axially offset at a predefined axial distance $D_{FP}$, the first and second fuel ports 220, 222 of the first bundled tube fuel nozzle 200 are axially offset at an axial distance $D_{P1}$ and the first and second fuel ports 320, 322 of the second bundled tube fuel nozzle 300 are axially offset at an axial distance $D_{P2}$.

In exemplary embodiments, the predefined axial distances $D_{P1}$ and/or $D_{P2}$ between the fuel ports 220, 222 and/or 320, 322 that is needed for optimum destructive interference depends, at least in part, on flow velocity of the mixture of the compressed air 18 and fuel flowing through the premix tubes 204, 304 and an identified frequency which is to be mitigated. For example, in particular embodiments the following formula may be used to determine the proper axial distance for either both $D_{P1}$ and/or $D_{P2}$:

$$D_{P2} = \frac{v_{(tube)}}{2 \cdot Freq}$$

where $v_{(tube)}$ corresponds to the flow velocity of the compressed air 18 and/or the compressed air and fuel mixture through the premixer tubes 204, 304 and Freq corresponds to a target frequency to be mitigated.

The system provided herein for combustion dynamic mitigation has several technological benefits over existing combustion dynamic mitigation systems for combustors having bundled tube fuel nozzles. For example, the combustor provided herein does not require any additional resonators for mitigating high frequencies. In addition, it allows for mitigation of both high and low frequency combustion dynamics. As a result, the potential adverse effects of combustion dynamics are decreased and the operability of the gas-turbine is increased.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A combustor, comprising:

a plurality of bundled tube fuel nozzles annularly arranged around a common axial centerline, the plurality of bundled tube fuel nozzles comprising a first bundled tube fuel nozzle and a second bundled tube fuel nozzle;

wherein the first bundled tube fuel nozzle includes a first fuel plenum and a first plurality of premix tubes which extend axially therethrough, wherein a first premix tube of the first plurality of premix tubes defines one or more first fuel ports including a most upstream first fuel port, and a second premix tube of the first plurality of premix tubes defines one or more second fuel ports including a most upstream second fuel port, the one or more first fuel ports and the one or more second fuel ports being disposed within and in fluid communication with the first fuel plenum, wherein the most upstream first fuel port is axially offset from the most upstream second fuel port, and wherein the first fuel plenum is axially offset with respect to the common axial centerline at a first non-zero distance from a first plane defined by inlet ends of the first plurality of premix tubes;

wherein the second bundled tube fuel nozzle includes a second fuel plenum and a second plurality of premix tubes which extend axially therethrough, wherein a first premix tube of the second plurality of premix tubes defines one or more third fuel ports including a most upstream third fuel port, and a second premix tube of the second plurality of premix tubes defines one or more fourth fuel ports including a most upstream fourth fuel port, the one or more third fuel ports and the one or more fourth fuel ports being disposed within and in fluid communication with the second fuel plenum, wherein the most upstream third fuel port is axially offset from the most upstream fourth fuel port, and wherein the second fuel plenum is axially offset with respect to the common axial centerline at a second non-zero distance from a second plane defined by inlet ends of the second plurality of premix tubes, the second plane being coincident with the first plane; and wherein the first non-zero distance is different from the second non-zero distance, such that the first fuel plenum is axially offset at a predefined, non-zero axial distance from the second fuel plenum with respect to the common axial centerline.

2. The combustor as in claim 1, wherein the first fuel plenum is at least partially defined by a first forward plate and a first aft plate and the second fuel plenum is at least partially defined by a second forward plate and a second aft plate, wherein the first forward plate is axially offset and positioned downstream from the second aft plate with respect to the common axial centerline.

3. The combustor as in claim 1, wherein the first fuel plenum is at least partially defined by a first aft plate and the second fuel plenum is at least partially defined by a second aft plate, wherein the first aft plate is axially offset from the second aft plate with respect to the common axial centerline.

4. The combustor as in claim 1, wherein the first plurality of premix tubes of the first bundled tube fuel nozzle and the second plurality of premix tubes of the second bundled tube fuel nozzle are equal in axial length.

5. A combustor comprising:

a plurality of bundled tube fuel nozzles annularly arranged around a common axial centerline, the plurality of bundled tube fuel nozzles comprising a first bundled tube fuel nozzle and a second bundled tube fuel nozzle;

wherein the first bundled tube fuel nozzle includes a first fuel plenum and a first plurality of premix tubes which extend axially therethrough, wherein each premix tube of the first plurality of premix tubes defines a first tube inlet, a first tube outlet, and a first fuel port disposed within and in fluid communication with the first fuel plenum;

wherein the second bundled tube fuel nozzle includes a second fuel plenum and a second plurality of premix tubes which extend axially therethrough, wherein each premix tube of the second plurality of premix tubes defines a second tube inlet, a second tube outlet, and a second fuel port disposed within and in fluid communication with the second fuel plenum;

wherein the first tube inlets of the first plurality of premix tubes and the second tube inlets of the second plurality of premix tubes reside in a common inlet plane, and the first tube outlets of the first plurality of premix tubes and the second tube outlets of the second plurality of premix tubes reside in a common outlet plane downstream of the common inlet plane;

wherein the first fuel plenum is axially offset with respect to the common axial centerline at a first non-zero distance from the common inlet plane, and the second fuel plenum is axially offset with respect to the common axial centerline at a second non-zero distance from the common inlet plane; and wherein the first non-zero distance is different from the second non-zero distance, such that the first fuel plenum is axially offset at a predefined, non-zero axial distance from the second fuel plenum.

6. The combustor as in claim 5, wherein the first fuel plenum is at least partially defined by a first forward plate and a first aft plate, and the second fuel plenum is at least partially defined by a second forward plate and a second aft plate; wherein the first forward plate is axially offset and positioned downstream from the second forward plate with respect to the common axial centerline.

7. The combustor as in claim 6, wherein the first fuel plenum is at least partially defined by a first aft plate and the second fuel plenum is at least partially defined by a second aft plate, wherein the first aft plate is axially offset from the second aft plate with respect to the common axial centerline.

8. The combustor as in claim 6, wherein the first fuel plenum is at least partially defined by a first forward plate and a first aft plate, and the second fuel plenum is at least partially defined by a second forward plate and a second aft plate; wherein the first forward plate is axially offset and positioned downstream from the second aft plate with respect to the common axial centerline.

9. The combustor as in claim 5, further comprising an end cover to which the plurality of bundled tube fuel nozzles is mounted; a first fluid conduit extending through the end cover to the first fuel plenum, thereby defining a first fluid conduit length; a second fluid conduit extending through the end cover to the second fuel plenum, thereby defining second fluid conduit length; and wherein the first fluid conduit length is different from the second fluid conduit length.

* * * * *